United States Patent [19]

Zilbert

[11] 4,094,432

[45] June 13, 1978

[54] INDUSTRIAL DRUMS

[75] Inventor: Seymour Zilbert, Demarest, N.J.

[73] Assignee: Bergen Barrel & Drum Co., Demarest, N.J.

[21] Appl. No.: 767,137

[22] Filed: Feb. 9, 1977

[51] Int. Cl.[2] ..... B65D 1/12; B65D 25/14

[52] U.S. Cl. ..... 220/404; 220/1 R; 220/67; 220/70; 220/288

[58] Field of Search ..... 220/1 R, 17, 63 R, 65, 220/66, 67, 70, 72, 288; 215/1 C

[56] References Cited

U.S. PATENT DOCUMENTS

| | | | |
|---|---|---|---|
| 3,432,069 | 3/1969 | Craig | 220/63 R |
| 3,437,231 | 4/1969 | Carpenter, Jr. | 220/63 R |
| 3,647,110 | 3/1972 | Hammes | 220/72 |
| 3,664,544 | 5/1972 | Hammes | 220/308 |
| 3,776,408 | 12/1973 | Wald | 220/63 R X |
| 3,784,039 | 1/1974 | Marco | 215/1 C X |
| 3,825,145 | 7/1974 | Reynolds | 220/288 X |
| 3,889,839 | 6/1975 | Simon et al. | 220/66 X |
| 3,915,330 | 10/1975 | Hammes et al. | 220/72 X |
| 3,927,790 | 12/1975 | Chase et al. | 220/72 |
| 3,985,257 | 10/1976 | Shaffer et al. | 220/72 X |

FOREIGN PATENT DOCUMENTS

| | | | |
|---|---|---|---|
| 992,475 | 7/1976 | Canada | 220/70 |

*Primary Examiner*—Stephen Marcus

[57] ABSTRACT

An industrial drum constructed of synthetic resin material by rotational molding, the material being a crosslinkable high density polyethylene resin having the ability to crosslink as the drum is molded. The top end wall of the drum carries a bung opening, and an integrally molded chime at the intersection of the top wall and the side wall has a configuration which enables gripping by a mechanized drum-handling apparatus and which includes a drain trough spaced at least a minimal distancefrom the bung opening. In one embodiment, the top end is threaded onto the side wall and a liner of relatively rigid synthetic material is placed in the drum, the liner having an upper lip with a threaded portion for placement interjacent the complementary threads of the top end and the side wall.

21 Claims, 9 Drawing Figures

INDUSTRIAL DRUMS

The present invention relates generally to industrial drums and pertains, more specifically, to industrial drums constructed of synthetic resin materials for use in the transportation and storage of goods which are usually in liquid form.

Industrial drums have long been a staple product used in the transportation and storage of goods in liquid and liquid-like forms. The now ubiquitous 55 gallon drum is an example of a versatile container which has been manufactured for many years in numerous forms. The conventional form for such drums is a cylindrical configuration with integral annular chimes. Such a configuration has been reduced to more-or-less standard shapes and dimensions to enable drum-handling equipment and storage facilities to be developed on a more uniform basis.

More recently, industrial drums have been constructed of synthetic resin materials in attempts to gain superior corrosion resistance and ease of manufacture, as well as other beneficial characteristics provided by the newer materials. However, the more commercially acceptable plastic drums have been constructed in configurations which depart from the widely accepted cylindrical drum with its annular chimes. Attempts at duplicating the accepted aspects of the conventional cylindrical drum in a synthetic resin drum have met with problems relating to attaining the appropriate strength in a container manufactured by economical molding techniques. In short, the most economical manufacturing techniques were limited to the use of materials which did not meet the requisite standards for strength and durability for containers such as the conventional fifty-five gallon cylindrical drum. On the other hand, those materials which did exhibit the desired physical characteristics could not be employed in economical molding techniques. The end result was that new configurations were developed which could be fabricated of synthetic resin materials having the desired physical characteristics using manufacturing techniques which were appropriate to the new configurations and materials, but the drums were not necessarily the most economical from the standpoint of providing all of the advantages previously attained by the conventional cylindrical drum by way of ease of handling and storage with conventional equipment.

It is an object of the present invention to provide an industrial drum having a construction which offers the advantages of present drums of conventional size and configuration, but which can be fabricated economically of a synthetic resin material which offers high strength and increased durability, as well as further advantages such as corrosion resistance and ease of maintenance.

Another object of the invention is to provide an industrial drum of synthetic resin material which duplicates the advantageous structural features of conventional drums such as a cylindrical configuration with annular chimes and a conventional type hung closure, while providing the enhanced characteristics of corrosion resistance and ease of maintenance, with requisite strength and durability.

Still another object of the invention is to provide an industrial drum constructed of a synthetic resin material through the use of a highly economical manufacturing process.

A further object of the invention is to provide an industrial drum of synthetic resin material having advantageous structural features which are attained economically through rotational molding of the drum of an appropriate synthetic resin material.

A still further object of the invention is to provide an industrial drum of molded synthetic resin material having a cylindrical configuration with an integral chime and a drain trough through the chime for precluding the accumulation of possible contaminants between the chime and the bung opening of the drum.

Still another object of the invention is to provide an industrial drum constructed of synthetic resin material and a liner of relatively rigid synthetic resin material for use in such a drum.

Another object of the invention is to provide an industrial drum and liner system for use in transporting and storing liquids and other materials with increased economy and wiith ease of use and maintenance.

The above objects, as well as still further objects and advantages, are attained by the present invention, which may be described briefly as an industrial drum constructed of synthetic resin material, the drum comprising a generally tubular body member extending longitudinally between opposite ends, and first and second end members, at least one of which is unitary with the tubular body member at one end thereof and closes that one end. The tubular body member, and at least the one of the end members unitary therewith, may be rotationally molded of a crosslinkable high density polyethylene resin having the ability to crosslink as the drum is molded. The drum can include at least one annular chime having a configuration and location which enables the chime to be gripped by the clamp of a drum handling apparatus to facilitate mechanized handling of the drum, and a drain trough passes radially through the chime at a specific circumferential location, relative to a bung opening in the drum. In another embodiment, the drum includes a detachable head end selectively affixed to the tubular body member by complementary screw threads, and a cupped liner of relatively rigid synthetic material for placement within the tubular body member, the liner having an annular lip with a threaded portion to be placed interjacent the complementary threads of the engaged head end and tubular body member.

The invention will be more fully understood, while still further objects and advantages will become apparent, by reference to the following detailed description of embodiments illustrated in the accompanying drawing, in which.

Figure 1:
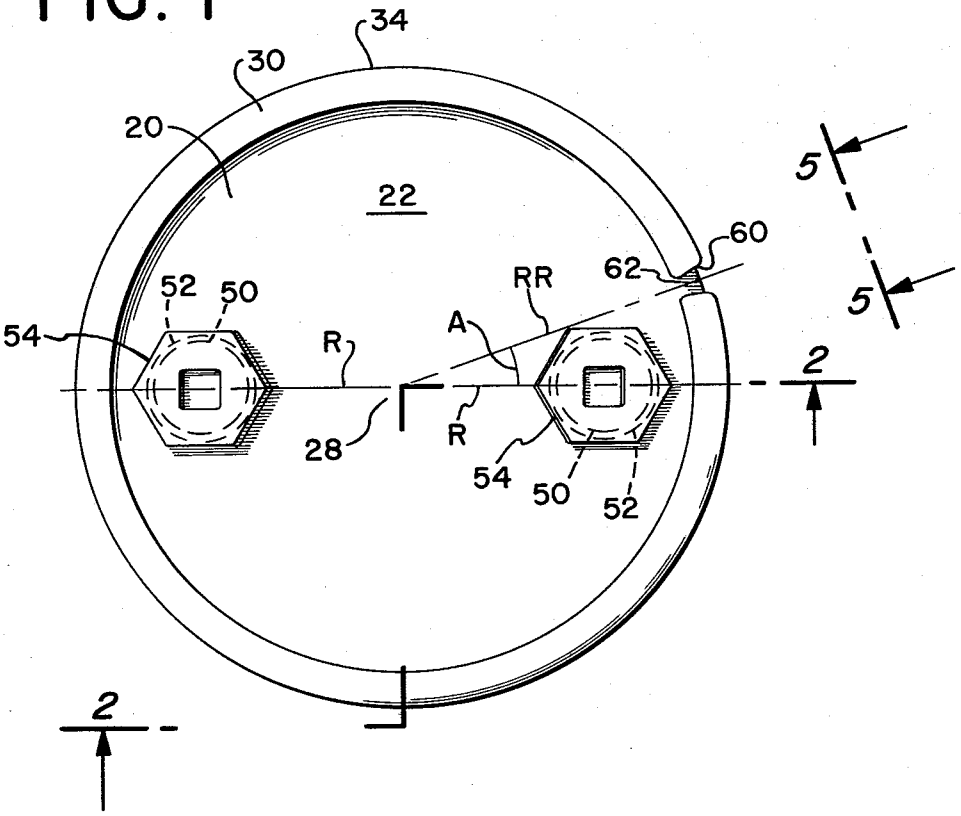
FIG. 1 is a top plan view of an industrial drum constructed in accordance with the invention.
Figure 3:
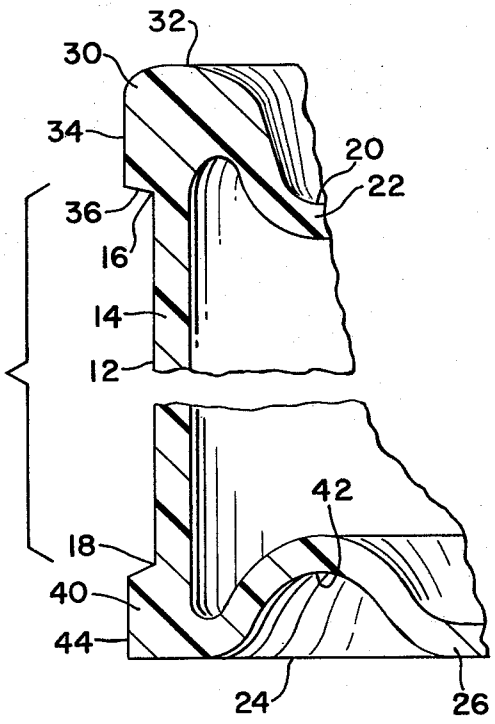
FIG. 3 is an enlarged, fragmentary view of portions of the drum.
Figure 2:
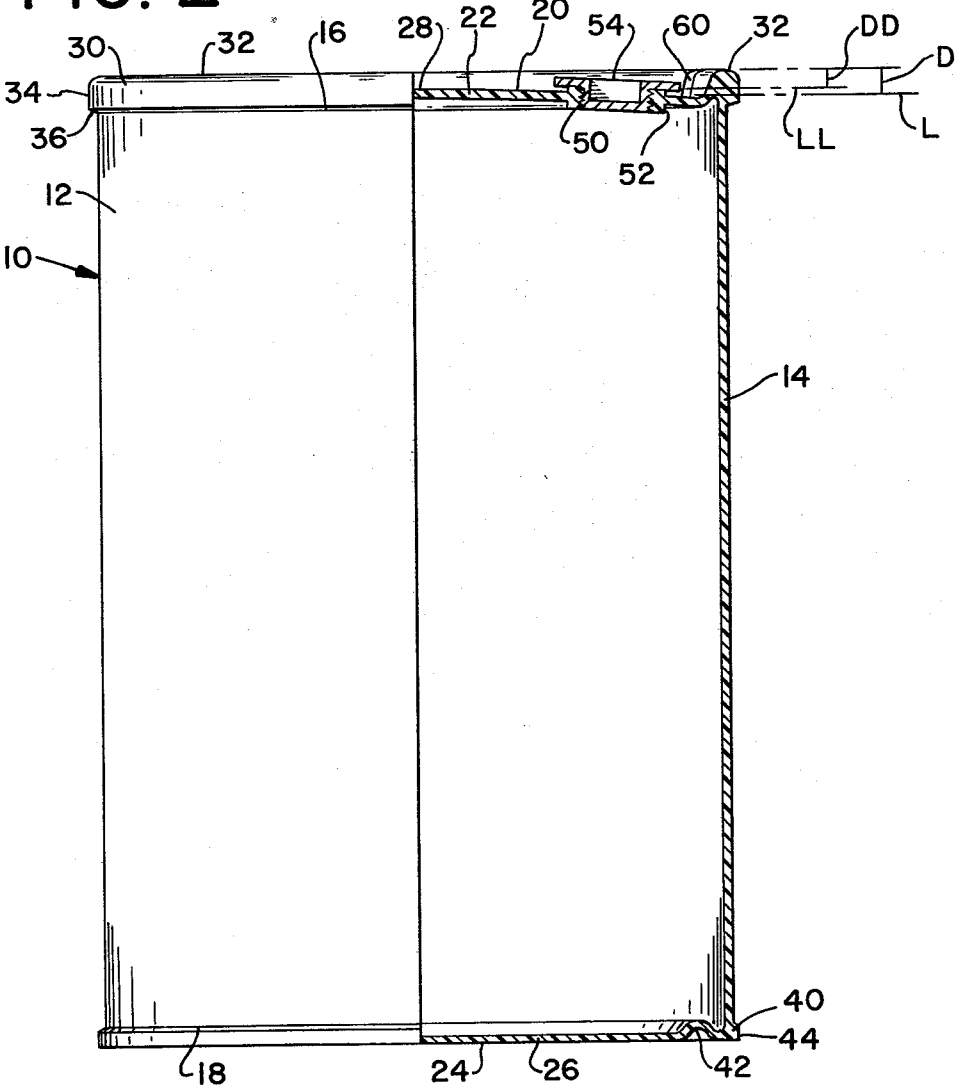
FIG. 2 is an elevational view of the drum, sectioned along line 2—2 of FIG. 1.

Referring now to the drawing, and especially to FIGS. 1, 2 and 3 thereof, an industrial drum constructed in accordance with the invention is illustrated at 10. Drum 10 has a generally tubular body member 12 which includes a unitary cylindrical side wall 14 extending longitudinally between a top 16 and a bottom 18.

A first end member 20 includes a generally circular top end wall 22 which, in this instance, is unitary with side wall 14. A second end member 24 includes a generally circular bottom end wall 26 which also is unitary with side wall 14. The first end member 20 is domed outwardly slightly at 28 for purposes which will be explained below.

A first chime 30 is integral with the side wall 14 and the top end wall 22 at the intersection of the side and top end walls 14 and 22. First chime 30 is generally annular and has a cross-sectional configuration which extends longitudinally upwardly, outwardly beyond the top end wall 22, and includes an outer edge 32 spaced longitudinally from the top end wall 22 (see FIG. 3). Chime 30 extends laterally outwardly to an outer portion in the form of radially outermost rim 34 which extends longitudinally between outer edge 32 and a shoulder 36.

A second chime 40 is integral with the side wall 14 and the bottom end wall 26 at the intersection of the side and bottom end walls 14 and 26. Bottom end wall 26 is generally flat, with the exception of an annular recess 42 extending around the bottom end wall 26 adjacent the second chime 40 (see FIG. 3) provided for purposes which will be explained hereinafter. Second chime 40 is generally annular and has a cross-sectional configuration which includes an outer portion in the form of radially outermost rim 44.

Figure 4:
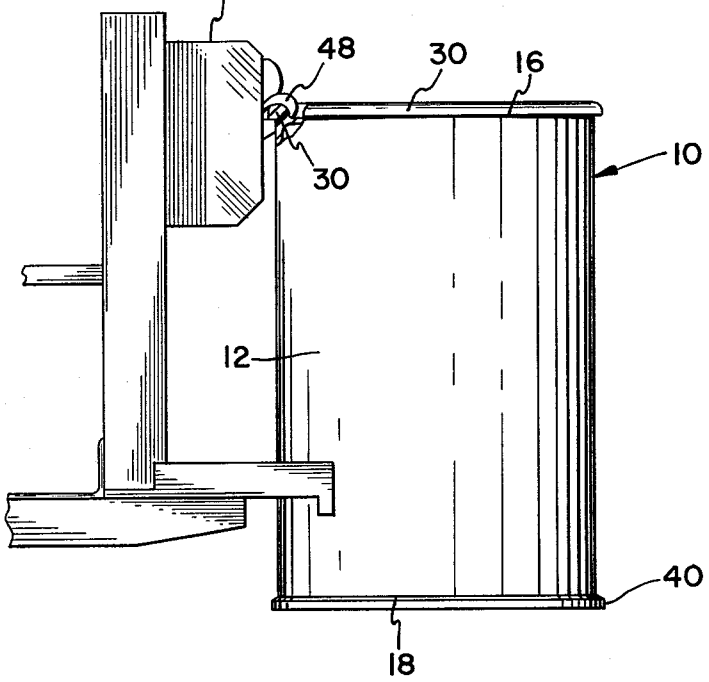
FIG. 4 is a pictorial elevational view illustrating handling of the drum with mechanized drum-handling equipment.

Thus, drum 10 has a configuration similar to conventional cylindrical drums presently available commercially in that the side wall 14 is cylindrical and annular chimes 20 and 40 are provided for ease of handling. Both chimes 30 and 40 are of the same diameter and are used when rolling the drum 10 and when storing the drum on its side. Drums of 55 gallon capacity often are handled and stored in such a manner. Manual lifting of the drum 10 is facilitated by the longitudinally extending configuration of chime 30 and the annular recess 42 adjacent chime 40, both of which provide for handholds at opposite ends 14 and 16 of the drum 10. In addition, drum-handling equipment such as that described in U.S. Pat. No. 2,814,403 may be utilized to handle drum 10, as seen in FIG. 4 wherein drum-handling apparatus 46 is seen to include a clamp 48 which grasps chime 30 for mechanized handling of drum 10.

The first end member 20 includes a pair of bung openings 50, each located on a radius R of the first end member 20 and passing through end wall 22, as seen in FIGS. 1 and 2. The two radii R are on the same diameter so that bung openings 50 are located in a now standard pattern in the first end member 20. End wall 22 includes an integral boss 52 at each bung opening 50, bosses 52 being threaded and shaped to receive a conventional type threaded bung closure 54.

Drum 10 is molded of a synthetic resin material, with the top, end wall 22, side wall 14, bottom end wall 26 and chimes 30 and 40 being molded in a unitary structure. In the preferred sizes, such as a drum having a capacity of 55 gallons, the completed drum must meet minimum requirements for impact strength, stiffness, long term load-bearing characteristics, chemical resistance, enivornmental stress cracking resistance and general toughness to qualify for widespread industrial use, particularly in connection with the transportation and storage of hazardous materials. Industry-wide standards have been formulated and must be met in a commercially feasible drum.

In order to meet such stringent requirments, most molded industrial drums have been blow molded from extra high molecular weight high density polyethylene resins capable of attaining maximum toughness. However, blow molding is relatively expensive for larger drums and, for a variety of reasons, is not feasible for configurations simulating the cylindrical metal drums now being used commercially.

A rotational molding process is feasible for molding the larger drum (of 55 gallon capacity) in a configuration resembling the currently available cylindrical metal drums, but the rotational molding process heretofore could not utilize the extra high molecular weight high density polyethylene materials which would produce drums with adequate physical and chemical properties. The rotational molding process requires molding materials having good flow characteristics during molding and those materials which provided the necessary good flow characteristics were not of the type having the extra high molecular weight which imparts the desired properties to the finished drum.

Drum 10 is constructed by rotational molding in order to attain the desired configuration. The synthetic resin material employed is chosen from crosslinkable high density polyethylene resins with good rotational molding characteristics, but which have the ability to crosslink as the drum is being molded. Such crosslinking produces a finished drum having physical properties somewhat characteristic of high density polyethylene resins of a molecular weight much higher than can normally be rotationally molded. Drums 10 which are rotationally molded of these crosslinkable high density polyethylene resins have good low temperature impact strength, long term load-bearing characteristics, environmental stress cracking resistance, and chemical resistance. Suitable high density polyethylene resins are commercially available under the name MARLEX and the designations CL-100 and CL-50 from Phillips Chemical Company. These resins provide the ability to fabricate drum 10 by rotational molding combined with the ability to crosslink as the drum is molded for enhanced physical and chemical properties in the completed drum.

Quite often, industrial drums such as drum 10 are stored in an upright position, as illustrated in FIG. 2. In such a position, contaminants can accumulate on the first end member 20, especially when the drum is stored outdoors where rainwater, as well as other contaminants, can fall upon the drum. Should the level of the accumulated contaminants rise above the level of the bung opening 50, as a result of the upward extent of chime 30, the contaminants can enter the interior of the drum through the bung opening 50, even when a closure 54 is present. In order to avoid such an accumulation of contaminants, it has been suggested that various drain structures be provided at the chime to enable the contaminants to be carried away and thus keep the top end wall free of contaminants, or at least keep the level of contaminants below the level of the bung opening. The provision of such drains in a metal drum was difficult since any drain which was low enough to be completely effective would interfere with the construction of a good joint between the top wall and the side wall of the drum. That is, the presence of a drain would weaken either the mechanical strength of the joint or the seal between the top wall and the side wall.

In a unitary molded construction, such as that of drum 10, an effective drain may be provided without affecting the mechanical strength or the seal at the intersection of top end wall 22 and side wall 14. As best seen in FIGS. 1, 2, 5 and 6, a drain is provided in the form of drain trough 60 passing radially through the chime 30 and extending longitudinally downwardly from the outer edge 32 of chime 30 to a bottom 62, the bottom 62 being spaced longitudinally inwardly a distance D at least equal to, and preferably greater than the longitudinal distance DD between the bung opening 50 and outer edge 32 so that bottom 62 is located at a level L which is not above, and preferably is well below the level LL of bung opening 50. The domed shape of top end wall 22 at 28 assures that potentially harmful levels of contaminants are drained through trough 60.

It has been found that in rotationally molding drum 10 of the appropriate synthetic resin materials, as described above, the drain trough 60 must be spaced at least a minimal distance from a bung opening 50 so as to allow adequate flow of the molding material during molding of the boss 52 and the modified wall structure surrounding the trough 60 to enable molding of the unitary structure without structural defects. Thus, trough 60 is located on a radius RR which is spaced from radius R at a minimum angle A of about 20°. Trough 60 may be placed at any circumferential location around the chime 30, beyond the location where radius RR makes an angle of about 20° with radius R; however, it is most desirable to locate the trough 60 near a bung opening 50 so that the trough 60 also serves to quickly drain away any excess drum contents, during either filling or emptying operations. Thus, plastic drum 10 is provided with the attributes of bung openings which are placed in a standard pattern and which accept standard bung closures, while including an effective drain trough construction.

Figure 7:
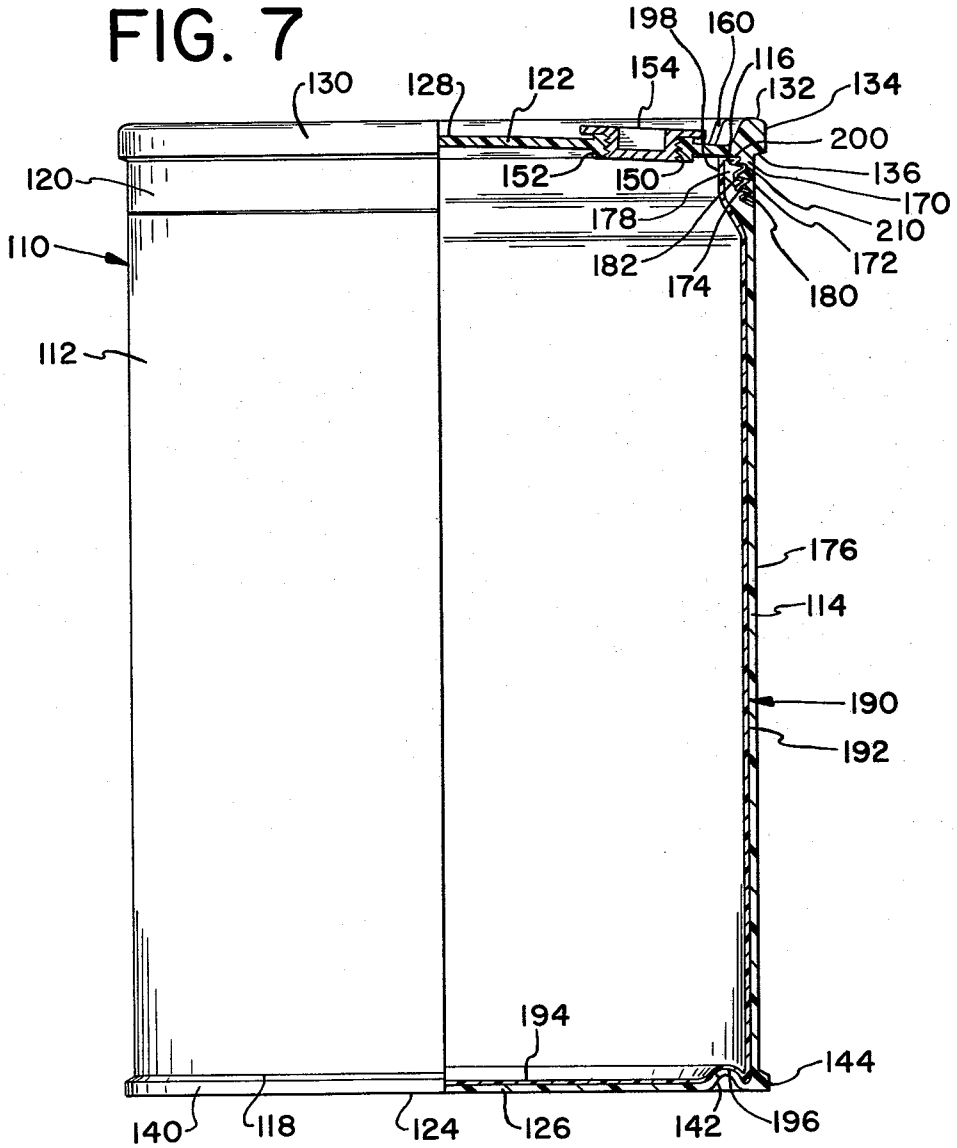
FIG. 7 is an elevational view similar to FIG. 2, but showing another embodiment of the invention.
Figure 5:
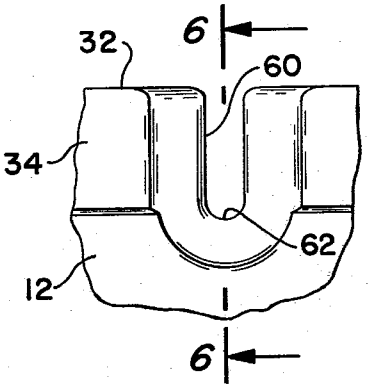
FIG. 5 is an enlarged fragmentary elevational view taken in the direction of the arrows 5—5 in FIG. 1.
Figure 6:
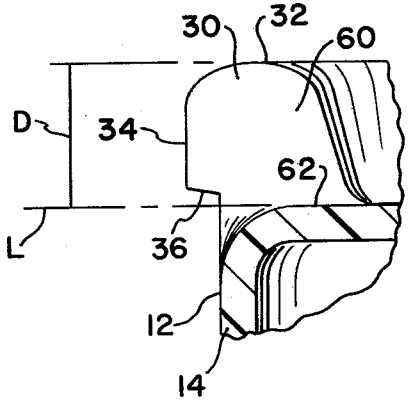
FIG. 6 is a cross-sectional view taken along line 6—6 of FIG. 3.
Figure 9:
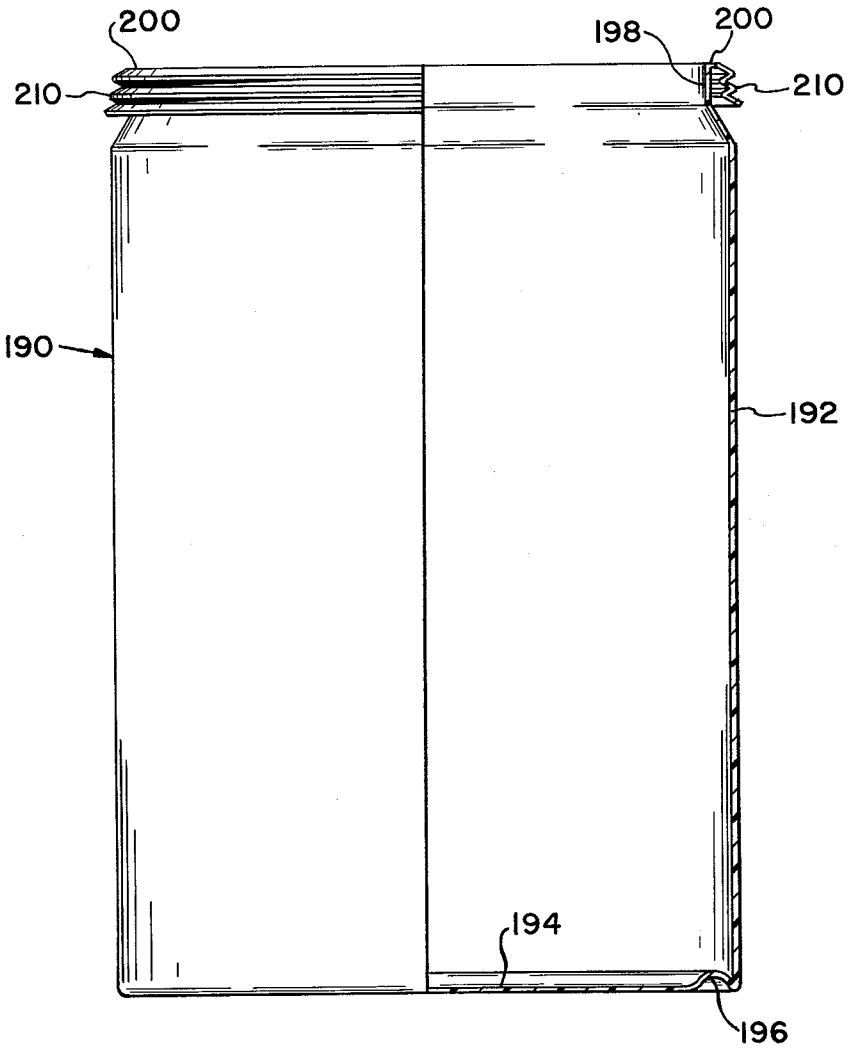
FIG. 9 is an elevational view, partially sectioned, of a liner for the drum of FIG. 7.
Figure 8:
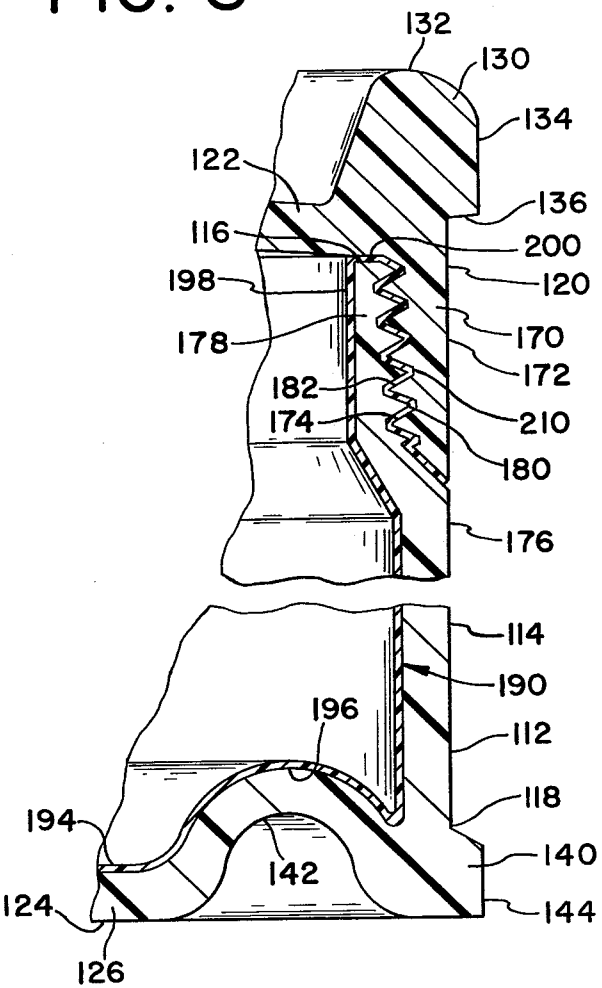
FIG. 8 is an enlarged, fragmentary view of portions of the drum of FIG. 7.

Turning now to FIGS. 7, 8 and 9, another industrial drum constructed in accordance with the invention is illustrated at 110. Drum 110 has a generally tubular body member 112 which includes a cylindrical side wall 114 extending longitudinally between a top 116 and a bottom 118.

A first end member 120 includes a generally circular top end wall 122. A second end member 124 includes a generally circular bottom end wall 126 which is unitary with side wall 114. The first end member 120 is domed outwardly slightly at 128.

A first chime 130 is integral with top end wall 122 and is generally annular. The cross-sectional configuration of chime 130 includes an outer edge 132 spaced longitudinally from the top end wall 122 (see FIG. 8). An outer portion in the form of radially outermost rim 134 extends longitudinally between outer edge 132 and a shoulder 136.

A second chime 140 is integral with the side wall 114 and the bottom end wall 126 at the intersection of the side and bottom end walls 114 and 126. Bottom end wall 126 is generally flat, with the exception of an annular recess 142 extending around the bottom end wall 126 adjacent the second chime 140 for purposes explained above in connection with drum 10. Second chime 140 is generally annular and has a cross-sectional configuration which includes an outer portion in the form of a radially outermost rim 144. Thus, the external configuration of drum 110 is similar to drum 10 and attains all of the advantages thereof, including the ability to be rotationally molded of a crosslinkable high density polyethylene resin having the ability to crosslink as the drum is molded. However, in this instance, the drum is constructed in more than one piece, as explained below.

First end member 120 is a head end and includes a pair of bung openings, one of which is illustrated at 150, each of which passes through top end wall 122. End wall 122 includes an integral boss 152 at each bung opening 150, each boss 152 being threaded and shaped to receive a standard bung closure 154. A drain trough 160 passes through the first chime 130 in a manner similar to that described above in connection with drum 10.

First end member 120 also includes a depending cylindrical skirt 170 having an outer surface 172 and an inner surface 174. Side wall 114 has an outer cylindrical surface 176 and includes a radially inwardly offset portion 178 having an external screw thread 180 on the outer surface thereof. An internal screw thread 182 is placed on the inner surface 174 of depending skirt 170.

In order to increase the ease of maintenance of drum 110, especially where the drum is to be utilized for the transport or storage of materials which are normally difficult to remove from the interior surface of the drum, a liner 190 is provided for insertion into the tubular body member 112 of drum 110. Liner 190 is generally cup-shaped so as to conform closely to the interior of tubular body member 112 and the cupped liner is fabricated of a synthetic resin material which is considered to be relatively rigid, as opposed to being loosely flexible. Thus, liner 190 has a cylindrical side wall 192, a circular bottom wall 194 with a recessed portion 196 at the closed bottom end of the liner, and an offset wall portion 198 at the open top of the liner, all complementary to the corresponding contours of the tubular body member 112. An annular lip 200 at the top end of the liner extends laterally outwardly and includes an annular portion 210 turned downwardly, that is, turned longitudinally back toward the closed bottom end of the liner to extend generally parallel to offset wall portion 198. Annular portion 210 is in the form of a screw thread complementary to external screw thread 180 on offset portion 178 of side wall 114, and to internal screw thread 182 on depending skirt 170.

Liner 190 is placed within tubular body member 112 with lip 200 overlapping the open top end of the side wall 114. The material of liner 190 possesses sufficient flexibility to enable insertion of the liner past the offset portion 178 of side wall 114. Once seated, the liner 190 is retained within the tubular body member 112 at least partly by engagement of the complementary offset portions 178 and 198. First end member 120 is then assembled with tubular body member 112 by threading skirt 170 over offset portion 178 of tubular body member 112, with annular portion 210 of lip 200 located interjacent the screw threads 180 and 182, as illustrated in FIGS. 7 and 8. The arrangement whereby the threaded annular portion 210 is captured between the threads 180 and 182 of the tubular body member 112 and the first end member 120 assures that the liner 190 is secured in place and that the drum 110 is sealed. Since, as a result of offset portion 178, the outer surface 172 of skirt 170 is provided with the same diameter as the outer surface 176 of side wall 114, the outer surface 172 and 176 will be flush, thus preserving the overall smooth cylindrical configuration of drum 110.

Filling and emptying of drum 110 can be accomplished in the usual way through bung openings 150. Maintenance and reconditioning can be accomplished by selective disassembly of first end member 120 from tubular body member 112 and removal and replacement of liner 190.

Since drums 10 and 110 each have an overall basic configuration similar to drums now in use, handling for transportation and storage is facilitated through the use of current equipment which is compatible with drums 10 and 110 and with drums now in use.

It is to be understood that the above description of embodiments of the invention is provided by way of example only. Various details of design and construction may be modified without departing from the true spirit and scope of the invention as set forth in the appended claims.

The embodiments of the invention in which an exclusive property or privilege is claimed are as follows:

1. An industrial drum constructed of synthetic resin material and capable of being gripped by a clamp of a drum-handling apparatus to facilitate mechanized handling of the drum, said drum comprising:

a generally tubular body member extending longitudinally between opposite ends and including a cylindrical side wall;

first and second end members, at least one of which is unitary with the tubular body member at one end thereof and closes said one end, the first and second members each including a circular end wall; and at least one chime molded unitary with a member of the drum, the chime having a configuration including portions extending longitudinally and laterally outwardly for being gripped by the clamp of the drum-handling apparatus, the chime being annular and being located at the intersection of one of the end members and the body member so as to extend circumferentially around substantially the entire perimeter of said one of the end members, the longitudinally extending portion of the chime extending outwardly beyond the end wall of said one of the end members at said intersection and including an outer edge spaced longitudinally from said intersection, and the laterally extending portion of the chime extending laterally beyond the cylindrical side wall;

the tubular body member, and at least the one of the end members unitary therewith, being rotationally molded of a crosslinkable high density polyethylene resin having the ability to crosslink as the drum is molded.

2. The invention of claim 1 including a bung opening in the end wall of said one of the end members, the bung opening being located on a first radius of said end wall and spaced from the center thereof; and a trough passing radially through the chime, the trough being located on a second radius of said end wall, the second radius being spaced at an angle of at least 20° from the first radius.

3. The invention of claim 2 wherein the angle between the first radius and the second radius is about 20°.

4. The invention of claim 2 wherein the trough includes a bottom located longitudinally inwardly relative to the longitudinally outer edge of the chime, the bottom of the trough being spaced longitudinally inwardly from the outer edge of the chime a distance at least equal to the longitudinal distance between the bung opening and the outer edge of the chime.

5. The invention of claim 2 including:

a second chime at the intersection of the other of the end members and the body member; and an annular recess in the end wall of the other of the end members, adjacent the second chime, for facilitating manual handling of the drum.

6. An industrial drum constructed of synthetic resin material, said drum comprising:

a generally tubular body member extending longitudinally between opposite ends;

first and second end members, at least one of which is unitary with the tubular body member at one end thereof and closes said one end;

the other of the ends of the tubular body member including an external thread integral therewith;

the other of the end members including an internal thread generally complementary to the external thread;

a cupped liner of relatively rigid synthetic resin material received within the tubular body member and having a tubular wall complementary thereto;

a closed end complementary to the unitary end member;

an opposite open end; and a lip at the open end of the liner, said lip including an annular portion turned longitudinally back toward the closed end and spaced laterally outwardly from the tubular wall of the liner, said annular portion being in the form of a thread complementary to the external thread of the tubular body and the internal thread of the other of the end members for reception between the external thread and the internal thread when the liner is in place within the drum and said other end member is threaded onto the tubular body member;

the tubular body member, and at least the one of the end members unitary therewith, being rotationally molded of a crosslinkable high density polyethylene resin having the ability to crosslink as the drum is molded.

7. The invention of claim 6 wherein the annular portion extends generally parallel to the tubular wall.

8. The invention of claim 6 wherein:

said tubular body member has a cylindrical outer surface, the external thread being located on a portion of the outer surface; and said other of the end members includes a cylindrical depending skirt having an outer surface and an inner surface, the internal thread being located on the inner surface;

the portion of the outer surface upon which the external thread is located being recessed radially such that the outer surface of the depending skirt of said other of the end members is flush with cylindrical outer surface of the tubular body member when said end member is threaded onto the tubular body member.

9. The invention of claim 8 wherein the tubular body member includes an end portion coextensive with the threaded portion of the cylindrical outer surface, said end portion being offset radially inwardly relative to the remainder of the tubular body member.

10. An industrial drum constructed of synthetic resin material and capable of being gripped by a clamp of a drum-handling apparatus to facilitate mechanized handling of the drum, said drum comprising:

a generally tubular body member extending longitudinally between opposite ends and including a cylindrical side wall;

first and second end members, at least one of which is unitary with the tubular body member at one end thereof and closes said one end, the first and second members each including a circular end wall; and at least one chime molded unitary with a member of the drum, the chime having a configuration including portions extending longitudinally and laterally outwardly for being gripped by the clamp of the drum-handling apparatus;

the chime being annular and being located at the intersection of one of the end members and the body member so as to extend circumferentially around substantially the entire perimeter of said one of the end members, the longitudinally extending portion of the chime extending outwardly beyond the end wall of said one of the end members at said intersection and including an outer edge spaced longitudinally from said intersection, and the laterally extending portion of the chime extending laterally beyond the cylindrical side wall.

11. The invention of claim 11 including:

a bung opening in the end wall of said one of the end members, the bung opening being located on a first radius of said end wall and spaced from the center thereof; and a trough passing radially through the chime, the trough being located on a second radius of said end wall, the second radius being spaced at an angle of at least 20° from the first radius.

12. The invention of claim 11 wherein the angle between the first radius and the second radius is about 20°.

13. The invention of claim 11 wherein the trough includes a bottom located longitudinally inwardly relative to the longitudinally outer edge of the chime, the bottom of the trough being spaced longitudinally inwardly from the outer edge of the chime a distance at least equal to the longitudinal distance between the bung opening and the outer edge of the chime.

14. The invention of claim 11 including:

a second chime at the intersection of the other of the end members and the body member; and an annular recess in the end wall of the other of the end members, adjacent the second chime, for facilitating manual handling of the drum.

15. An industrial drum constructed of synthetic resin material, said drum comprising:

a generally tubular body member extending longitudinally between opposite ends; and first and second end members, one of which is unitary with the tubular body member at one end thereof and closes said one end;

an external thread integral with the other of the ends of the tubular body member;

an internal thread on the other of the end members, said internal thread being generally complementary to the external thread;

a cupped liner of relatively rigid synthetic resin material received within the tubular body member and having a tubular wall complementary thereto, a closed end complementary to the unitary end member, and an opposite open end; and a lip at the open end of the liner, said lip including an annular portion turned longitudinally back toward the closed end and spaced laterally outwardly from the tubular wall of the liner, said annular portion being in the form of a thread complementary to the external thread of the tubular body and the internal thread of the other of the end members for reception interjacent the external thread and the internal thread when the liner is in place within the drum and said other end member is threaded onto the tubular body member.

16. The invention of claim 15 wherein the annular portion extends generally parallel to the tubular wall.

17. The invention of claim 15 wherein:

said tubular body member has a cylindrical outer surface, the external thread being located on a portion of the outer surface; and said other of the end members includes a cylindrical depending skirt having an outer surface and an inner surface, the internal thread being located on the inner surface;

the portion of the outer surface upon which the external thread is located being recessed radially such that the outer surface of the depending skirt of said other of the end members is flush with cylindrical outer surface of the tubular body member when said end member is threaded onto the tubular body member.

18. The invention of claim 17 wherein the tubular body member includes an end portion coextensive with the threaded portion of the cylindrical outer surface, said end portion being offset radially inwardly relative to the remainder of the tubular body member.

19. For use in an industrial drum having a generally tubular body member extending longitudinally between opposite ends, first and second end members, one of which is unitary with the tubular body member at one end thereof and closes said one end, an external thread integral with the other of the ends of the tubular body member, and an internal thread on the other of the end members, said internal thread being generally complementary to the external thread, the improvement comprising:

a cupped liner of relatively rigid synthetic resin material for reception within the tubular body member, said cupped liner having a tubular wall complementary to the tubular body member;

a closed end complementary to the unitary end member;

an opposite open end; and a lip at the open end of the liner, said lip including an annular portion turned longitudinally back toward the closed end and spaced laterally outwardly from the tubular wall of the liner, said annular portion being in the form of a thread complementary to the external thread of the tubular body and the internal thread of the other of the end members for reception interjacent the external thread and the internal thread when the liner is in place within the drum and said other end member is threaded onto the tubular body member.

20. The invention of claim 19 wherein the annular portion extends generally parallel to the tubular wall.

21. The invention of claim 20 wherein the annular portion of the lip and the portion of the tubular wall overlapped by the annular portion are offset radially inwardly from the remainder of the tubular wall.

* * * * *

REEXAMINATION CERTIFICATE (1418th)

United States Patent [19]

Zilbert

[11] B1 4,094,432

[45] Certificate Issued Feb. 26, 1991

[54] INDUSTRIAL DRUMS

[75] Inventor: Seymour Zilbert, Demarest, N.J.

[73] Assignee: Bergen Barrel & Drum Co., Demarest, N.J.

Reexamination Request:
No. 90/001,878, Oct. 30, 1989

Reexamination Certificate for:

| | |
|---|---|
| Patent No.: | **4,094,432** |
| Issued: | **Jun. 13, 1978** |
| Appl. No.: | **767,137** |
| Filed: | **Feb. 9, 1977** |

1/24/1979

[51] Int. Cl.[5] ..... B65D 1/12; B65D 25/14

[52] U.S. Cl. ..... 220/404; 220/288; 220/511; 220/605; 220/661; 220/672

[58] Field of Search ..... 220/1 R, 66.72, 288; 215/1 C

[56] References Cited

U.S. PATENT DOCUMENTS

| | | | |
|---|---|---|---|
| 3,050,773 | 8/1962 | Hagen | 215/16 |
| 3,970,736 | 7/1976 | Gimaret . | |
| 3,976,821 | 8/1976 | Carrow et al. . | |
| 4,029,729 | 6/1977 | Rees et al. . | |
| 4,257,527 | 3/1981 | Snyder | 220/72 |

OTHER PUBLICATIONS

Major Repair Kit by Stewart-Warner Corporation, Mar. 1968.

*Primary Examiner*—Stephen Marcus

[57] ABSTRACT

An industrial drum constructed of synthetic resin material by rotational molding, the material being a crosslinkable high density polyethylene resin having the ability to crosslink as the drum is molded. The top end wall of the drum carries a bung opening, and an integrally molded chime at the intersection of the top wall and the side wall has a configuration which enables gripping by a mechanized drum-handling apparatus and which includes a drain trough spaced at least a minimal distancefrom the bung opening. In one embodiment, the top end is threaded onto the side wall and a liner of relatively rigid synthetic material is placed in the drum, the liner having an upper lip with a threaded portion for placement interjacent the complementary threads of the top end and the side wall.

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 1–9 and 11–21 is confirmed.

Claim 10 was previously disclaimed.

* * * * *